US005111744A

United States Patent [19]

Wieland

[11] Patent Number: 5,111,744

[45] Date of Patent: May 12, 1992

[54] METHOD AND APPARATUS FOR AUTOMATICALLY CHANGING A PRINTING PLATE

[75] Inventor: Erich G. Wieland, Wurzburg, Fed. Rep. of Germany

[73] Assignee: Koenig & Bauer Aktiengesellschaft, Wurzburg, Fed. Rep. of Germany

[21] Appl. No.: 621,966

[22] Filed: Dec. 4, 1990

[30] Foreign Application Priority Data

Dec. 9, 1989 [DE] Fed. Rep. of Germany ..... 3940796

[51] Int. Cl.[5] ..... B41F 27/06; B41F 27/12

[52] U.S. Cl. ..... 101/216; 101/415.1; 101/486

[58] Field of Search ..... 101/132.5, 415.1, 141, 101/142, 143, 144, 409-411, 233, 234, 216, 132, 136, 232, 137, 138, 483, 486; 271/265, 258, 259

[56] References Cited

U.S. PATENT DOCUMENTS 3,793,950 2/1974 Kaneko et al. ..... 101/130 X
3,874,290 4/1975 Suzuki ..... 101/132.5
3,903,795 9/1975 Suzuki ..... 101/409
4,858,528 8/1989 Inoue et al. ..... 10/415.1

FOREIGN PATENT DOCUMENTS 0268857 6/1988 European Pat. Off. .
1118807 12/1961 Fed. Rep. of Germany .
2330947 1/1974 Fed. Rep. of Germany .
3604071 8/1987 Fed. Rep. of Germany .
3626936 2/1988 Fed. Rep. of Germany .

*Primary Examiner*—J. Reed Fisher
*Attorney, Agent, or Firm*—Jones, Tullar & Cooper

[57] ABSTRACT

A method and apparatus for automatically changing a printing plate on a rotary printing machine utilizes two adjacent storage compartments which are located beside the peripheral surface of a plate cylinder. A first printing plate's trailing edge is released from the plate cylinder and is guided into a first one of the storage compartments. This first plate is fed into the first storage compartment and a second plate is directed out of the second storage compartment and is attached to the surface of the plate cylinder.

14 Claims, 6 Drawing Sheets

METHOD AND APPARATUS FOR AUTOMATICALLY CHANGING A PRINTING PLATE

FIELD OF THE INVENTION

The present invention is directed generally to a method and apparatus for automatically changing a printing plate. More particularly, the present invention is directed to a method and apparatus for automatically changing a printing plate on a plate cylinder of a rotary printing machine. Most specifically, the present invention is directed to a method and apparatus for automatically changing a printing plate on a plate cylinder utilizing a multiple compartment storage chamber for the printing plates being changed. The storage chamber is positioned adjacent the plate cylinder and uses two plate storage compartments, one for the plate to be removed and another for the plate to be installed. Suitable controls are provided to allow the plate change to be accomplished in an entirely automatic manner.

DESCRIPTION OF THE PRIOR ART

In the field of rotary printing, a printing plate is typically manually attached to the outer periphery of a printing plate cylinder and is held on the plate cylinder by generally well-known printing plate clamps. The attachment of the printing plate to the plate cylinder by conventional manual means exposes the operator to a significant risk. It is always possible that the person handling the printing plate and attaching it to the plate cylinder will injure himself by becoming caught on the printing equipment. In order to attempt to avoid this potential risk of injury, the prior art has proposed semi-automatic printing plate changing assemblies.

One semi-automatic assembly which is intended for use in the attachment or fastening of a printing plate to the periphery of a plate cylinder of a rotary printing machine is shown in European patent application No. 0268857. In this prior art device, the printing plate must be manually placed or inserted into the plate clamping device which is a portion of the plate cylinder. This manual positioning of the plate in the plate clamping device exposes the hands of the operator to possible danger.

The prior art semi-automatic printing plate fastening and changing assembly disclosed in this European patent utilizes a plurality of manually operable switches to carry out the various steps, such as plate feeding, clamping and tightening. This prior art device is thus only partly automatic and requires the attention of an operator to change a printing plate on the surface of the plate cylinder.

It will be apparent that a need exists for a method and apparatus for automatically changing a printing plate. The present invention provides such a device and is a significant improvement over the prior art devices.

SUMMARY OF THE INVENTION

It is an object of the present invention to provide a method and apparatus for automatically changing a printing plate.

Another object of the present invention is to provide a method and apparatus for automatically changing a printing plate on a plate cylinder of a rotary printing machine.

A further object of the present invention is to provide a method and apparatus for changing a printing plate in which the plates being changed are taken from and returned to a storage chamber.

Yet another object of the present invention is to provide a method and apparatus for automatically changing a printing plate which utilizes automatic control.

Still a further object of the present invention is to provide a method and apparatus for automatically changing a printing plate that requires no contact of the plate or cylinder by the operating staff.

As will be presented in detail in the description of the preferred embodiment which is set forth subsequently, the method and apparatus for automatically changing a printing plate on a plate cylinder of a rotary printing machine in accordance with the present invention utilizes a printing plate storage chamber that has at least two adjacent compartments. The printing plate to be removed from the plate cylinder has its trailing edge unclamped from the plate cylinder. The cylinder is then operated in a reverse direction while the now free trailing edge of the plate to be removed is directed into a first compartment of the storage chamber. Once the plate cylinder has been backed up until the leading edge of the plate to be removed is adjacent the entrance to the storage chamber, the leading edge of the plate is unclamped and the plate is transferred fully into the first compartment by use of automatically controlled rollers. The plate to be secured to the plate cylinder is then transferred out of the second compartment of the storage chamber and its leading edge is clamped to the plate cylinder. The cylinder may now be rotated forwardly to wrap the plate about the cylinder. When the trailing edge of the plate being put onto the cylinder reaches the trailing edge clamping assembly, it is automatically secured in place. Suitable control devices and a control computer are used to effect the fully automatic changing of the plate on the plate cylinder.

The apparatus for changing a printing plate in accordance with the present invention is fully automatic. In contrast with prior art devices, it does not require manual clamping or unclamping of the plate to the cylinder and does not require manual activation of various switches and control devices. This means that an auxiliary or support staff person, as opposed to a skilled press operator, can insert the printing plates to be changed into the appropriate compartments of the storage chamber.

Since the apparatus is fully automatic and since the staff effecting the plate changes need only insert the plates into, and remove the plates from the storage chamber, there is less risk of injury to the personnel. This increases staff safety. It also shortens the stop periods of the press during plate changes.

A further advantage of the method and apparatus for automatically changing a printing plate is that it is easier to accurately position the printing plate on the plate cylinder. This accurate positioning insures proper registry of the plate and thus avoids high waste rates of printed products which are created during lengthy register corrections.

The method and apparatus for automatically changing a printing plate in accordance with the present invention overcomes the limitations of the prior art devices and is a substantial advance in the art.

BRIEF DESCRIPTION OF THE DRAWINGS

While the novel feature of the method and apparatus for automatically changing a printing plate in accordance with the present invention are set forth with particularity in the appended claims, a full and complete understanding of the invention may be had by referring to the detailed description of the preferred embodiment which is presented subsequently and as illustrated by the accompanying drawings, in which:

DETAILED DESCRIPTION OF THE PREFERRED EMBODIMENT

Figure 1:
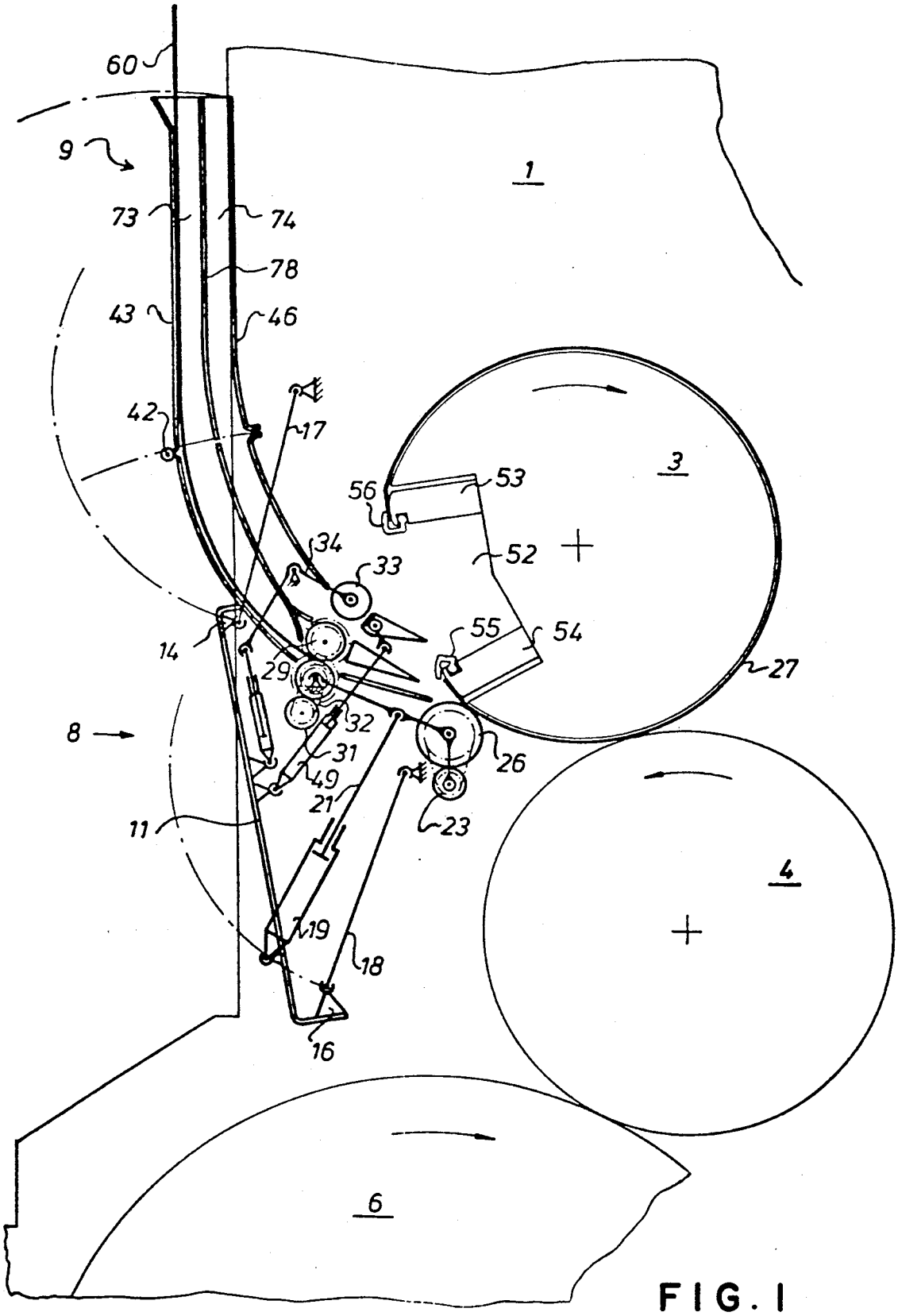
FIG. 1 is a side elevation view, partly in section, of the automatic printing plate changing apparatus in accordance with the present invention.

Referring initially to FIG. 1, there may be seen a preferred embodiment of the apparatus for automatically changing a printing plate in accordance with the present invention. As may be seen in FIG. 1, there is shown one printing unit, generally at 1 of a multiple unit rotary printing machine which may have, for example, four or more similar printing units 1. Each printing unit 1 has, in addition to other elements, a plate cylinder 3, a blanket cylinder 4 and an impression cylinder 6. Each of these cylinders is supported in a generally conventional manner in spaced side frames (not specifically shown) of the rotary printing machine. Since the various printing units which make up the rotary printing machine are generally the same in structure and operation, only one such printing unit will be discussed hereinafter.

A printing plate changing device, generally at 9 in accordance with the present invention, is located on an access side 8 of the plate, blanket, and impression cylinders 3, 4 and 6, respectively. The printing plate changing device 9 is fastened to a movable cover plate 11. This cover plate 11 is movable vertically between two end positions with respect to the printing plate changing device 9 by means of two swinging arms 17 and 18 which are fixed to the side frames of the printing unit 1. The radii of movement of cover plate 11 are represented by broken lines. For this purpose, an upper joint and a lower joint 14 and 16 which receive a first end of the swinging arms 17 and 18, respectively, for pivotal support, are provided on cover plate 11. Second ends of the swinging arms 17 and 18 are pivotably supported respectively at the side frames. The cover plate; 11, which also acts as a connecting rod, the swinging arms 17 and 18 and the frame of the printing unit 1 thus form a joint square.

A double acting working cylinder 19 is pivotably supported at a lower end at either side of the cover plate 11. A piston rod 21 of each working cylinder 19 is hinged with a lever 22 as seen most clearly in FIG. 2. The lever 22 carries, at its first end, a press-on roller 26 which is pivotably supported and is arranged with its axis parallel to the axis of the plate cylinder 3. This press-on roller 26 has a suitable drive roller, generally at 23. As may be seen in dot dash lines in FIG. 1, this drive roller 23 may carry a sprocket and may be joined to press-on roller 26 by a chain. Press-on roller 26 may be recessed. It has a relatively soft surface such as rubber or plastic and is thus softer than a surface of a printing plate 27 that may be carried on the peripheral surface of plate cylinder 3.

Figure 2:
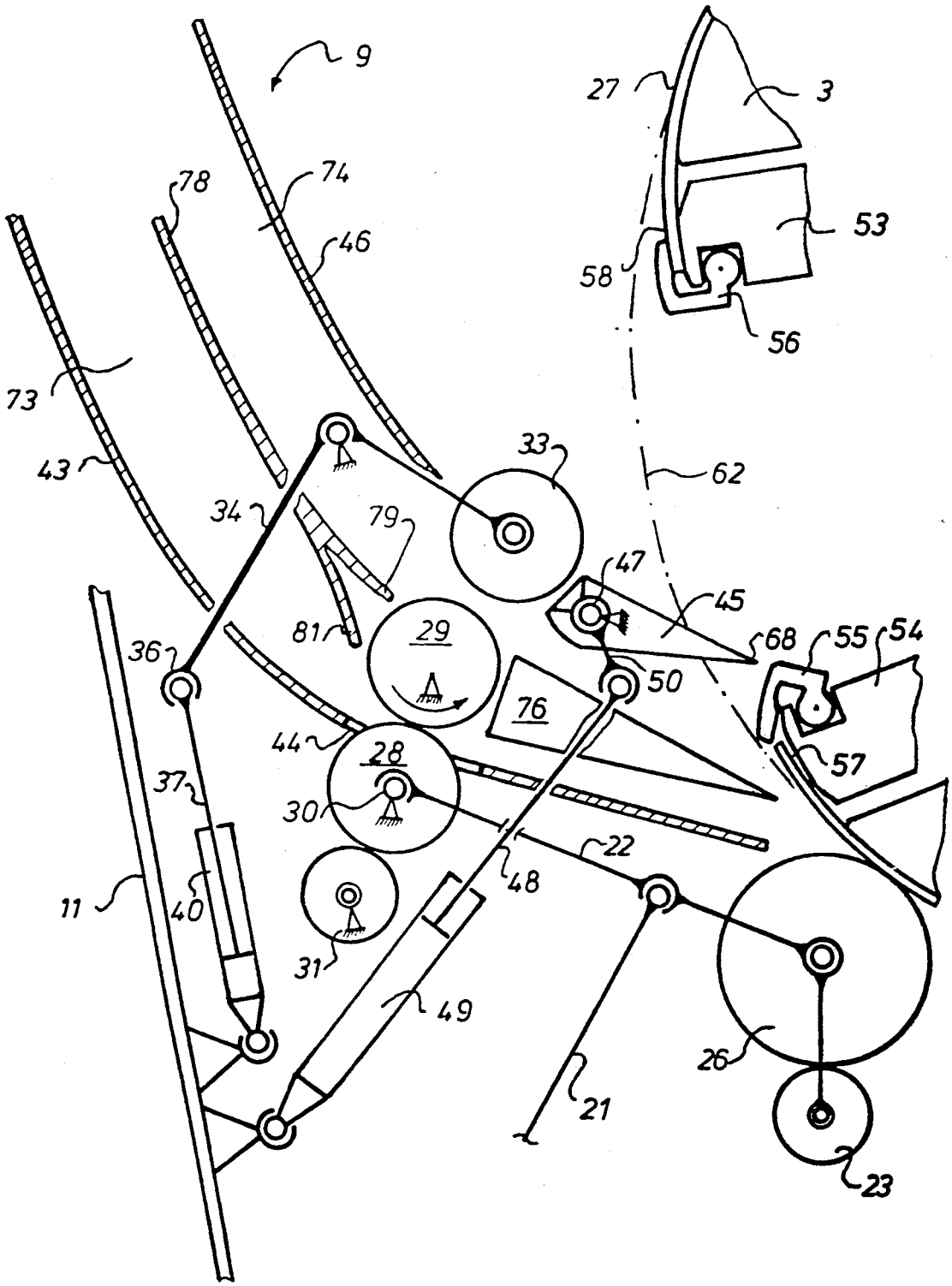
FIG. 2 is an enlarged side elevation view, partly in section of a portion of the apparatus depicted in FIG. 1.

A second end of lever 22 is pivotably supported about an axis 30 of a driving roller 28. This driving roller is rotatably supported at its ends by suitable supports (not shown) that are carried by the cover plate 11. This driving roller 28 may be recessed and has a suitable drive means, such as a gear drive, an electric motor, a pneumatic motor or the like. In the preferred embodiment, as seen in FIG. 2, a sprocket wheel 31 may be connected to the drive motor and may drive the driving roller 28 by means of a chain 32 which is depicted in FIG. 1. If desired, the driving roller 28 and the press-on roller 26 can be in driving connection with each other by, for example, a suitable drive chain. In such a configuration, both of these rollers will rotate at the same circumferential speed.

The driving roll 28 is in driving contact, such as through a gear drive, with a second driving roll 29 in such a way that the driving rolls 28 and 29 turn in opposite directions so that they have the same transport direction in a roller nip formed by the driving rolls 28 and 29. All of the transport rolls have a soft, elastic surface such as rubber, which is at least softer than the printing plates 27 and 60 which are used so that the rolls cannot damage the printing plates 27 and 40.

Referring again to FIG. 2, a second press-on roller 33 is supported so that it can be moved into contact with the surface of the second driving roller 29. This is accomplished by rotatably supporting the second press-on roller 33 at a first end of a two-arm lever 34. This two-arm lever 34 is supported generally at its midpoint or apex in the side support for the cover plate 11. A bearing position 36 is provided at a second end of the two-arm lever 34. This bearing position 36 is connected to a free end of a piston rod 37 which is part of a working cylinder 40 that is, in turn, secured to the cover plate 11. Thus, movement of the piston rod 37 will pivot the two-arm lever 34 about its central or apex support and will move the second press-on roller 33 into or out of contact with the surface of the second driving roller 29.

The printing plate changing device 9 includes a housing or chamber which is about as wide as the printing plates and which includes at least two storage compartments 73 and 74, as may be seen in FIGS. 1 and 2. The housing has, as seen in section, a slight curvature in such a way that an upper part of the housing is almost vertically aligned and a lower part of the housing is tangentially aligned to a lower part of the plate cylinder 3. As may be seen in FIG. the housing has two parts which are connected by a hinge 42 above the cover plate 11. An upper part of the housing can thus be tilted downward so that an upper part of the printing unit or tower 1 in which, in the usual way, an inking unit (not shown) of the printing machine is provided, is accessible to an operating person.

Referring again primarily to FIG. 2, a front wall 43 of the housing extends downwardly to a point shortly before the press-on roller 26 and has openings 44 in the area of the driving roll 28, through which surface areas of the recessed driving roll 28 jut into the first storage compartment 73. A back wall 46 of the housing is generally parallel to the front wall 43 and extends downwardly to a point just before the press-on roll 33. An intermediate wall 78 separates the first and second storage compartments 73 and 74 from each other and stretches until shortly before the driving roll 29 where it ends in two diverging guiding metal sheets 79 and 81 which make sure that the printing plate 27 or 60 which is to be fed or carried off reaches the correct roller nip.

Several spaced lifting fingers 45 are provided ahead of the press-on roll 33 and are supported parallely to a wedge-shaped guiding metal sheet 76. These lifting fingers 45 are firmly arranged on a lifting finger shaft 47 that is rotatably supported in the lateral supports of the cover plate 11. At a distance from the bearings of the lifting finger shaft 47, a piston rod 48 articulately meshes with a lever 50 of the lifting finger shaft 47 so as to operate it. The piston rod 48 has a first end which is connected to a free end of the lifting finger lever 50. The piston rod 48 is part of a working cylinder 49 which is articulately fastened to the cover plate 11. The lifting fingers 45 are to be swiveled by means of the piston rod 48 in such a way that their peaks 68 dip into the periphery 62 of the plate cylinder 3 or lift off the periphery 62 of the plate cylinder 3, as may be seen more clearly in FIG. 2.

Figure 3:
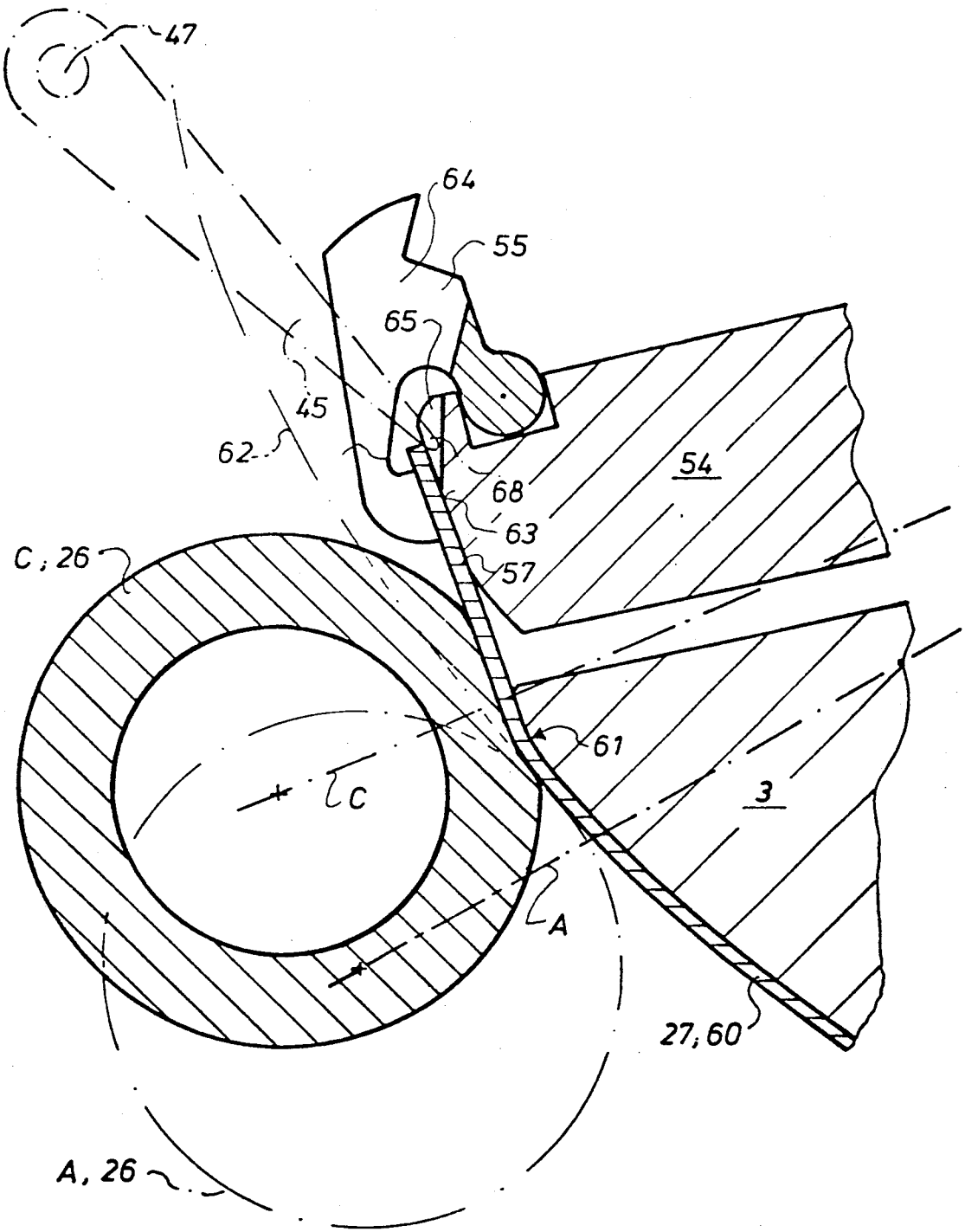
FIG. 3 is an enlarged side elevation view of the printing plate trailing end clamping portion of the device and showing the apparatus in a printing plate clamping position.
Figure 4:
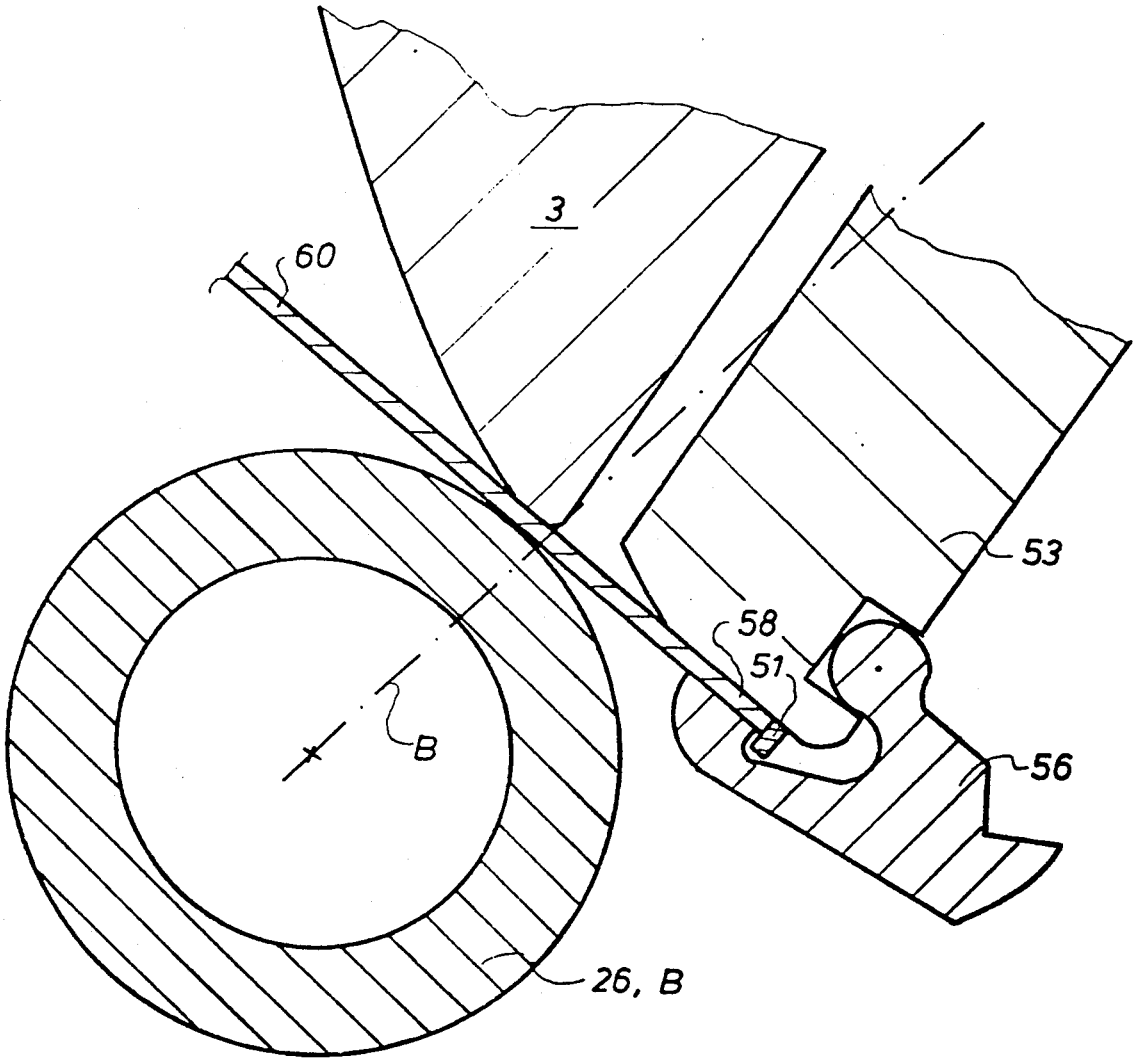
FIG. 4 is an enlarged side elevation view of the printing plate leading end clamping portion of the device and showing the apparatus in a printing plate feeding position.

Turning again to FIG. 1 in conjunction with FIG. 2, the plate cylinder 3 has two spaced plate clamping and tightening devices 53 and 54, located in a groove 52. The plate clamping devices are generally shown in German patent specification 36 26 936 and are not a part of the present invention. These plate clamping and tightening devices are particularly suited for use in this invention because of their use of a swiveling pole for the clamping bars 55 and 56. This has the effect that a printing plate end 57 is not hindered when putting it in or taking it out of the plate clamping device 54 by the clamping bar 55. The plate cylinder 3 is also provided with a generally well-known printing plate tightening device which is not specifically shown. A suitable plate tightening device which can be used with the present invention is shown in German published unexamined patent application 3,604,071. These plate clamping and tightening devices 53 and 54 are operated by a suitable working medium, such as compressed air or hydraulic fluid through generally conventional swivel fittings at the plate cylinder journal. It would also be possible to provide devices which would supply a working medium to the front surface of the plate cylinder 3 when the plate cylinder comes to a stop in any one of the several plate cylinder positions A, B, or C, as depicted in FIGS. 3 and 4 and as will be discussed subsequently. The adjusting means for the clamping and tightening devices 53 and 54 could be hydraulic, pneumatic, mechanical or electrical assemblies.

The operational sequence of the apparatus for automatically changing a printing plate in accordance with the present invention will now be set forth in detail. During printing, the printing plate storage assembly 9 is in a position shown in FIG. 1 and FIG. 2. The access to the cylinders 3, 4 and 6 is closed in this position by the cover plate 11. The press-on roller 26 and the lifting fingers 45 are swiveled off the plate cylinder 3. After finishing the current print order, the plate cylinder 3 is rotated into a pre-determined angle position A which is a printing plate releasing position, as seen in FIG. 3. The clamping bar 55 is then opened. A printing plate trailing end 57 springs, by its elastic internal tension, outward until it stops at the guiding metal sheet 76 or is lifted from the clamping abutment surface 63 by the lifting fingers 45 during turning of the plate cylinder 3 into the printing plate clamping position C which is also depicted in FIG. 3. When turning the plate cylinder 3 from a printing plate releasing position A clockwise or backwards and by supplying the working cylinder 49 with pressure, the peaks 68 of the lifting fingers 45 extend into troughs 65 in the plate clamping and tightening device 54, through openings 64 in the clamping bar 55 and 60, under the printing plate end 57 and thus support a lifting of the printing plate end 57 from a clamping abutment surface 63. In a printing plate releasing or feeding position A or B the press-on roller 26 is thrown on the plate cylinder 3.

As the plate cylinder 3 rotates clockwise or backwards this has the effect of pushing the trailing end 57 of printing plate 27 out into the second storage compartment 74 with the press-on roller 26 being driven counter-clockwise with a pre-set torsional moment. The torsional moment is not allowed to exceed the friction between plate 27 or 60 and roller surface 26. The printing plate end 57 reaches a gap between the driving roll 29 and the thrown off press-on roll 33. The printing plate 27 continues being transported into the storage compartment 74 through the gap between the transport rolls 29 and 33 until the plate cylinder 3 reaches the printing plate feeding position B shown in FIG. 4, and until the clamping bar 55 for holding the printing plate beginning end 58 starts to open. Almost at the same time, the press-on roll 33 is thrown onto the driving roll 29 by means of the working cylinder unit 37 and 40. Activating the drive 31 and 32 now has the effect that the printing plate 27 is taken away from the feeding area, which is the lower part of the printing plate changing device 9, and is fed to the second storage compartment 74.

Figure 5:
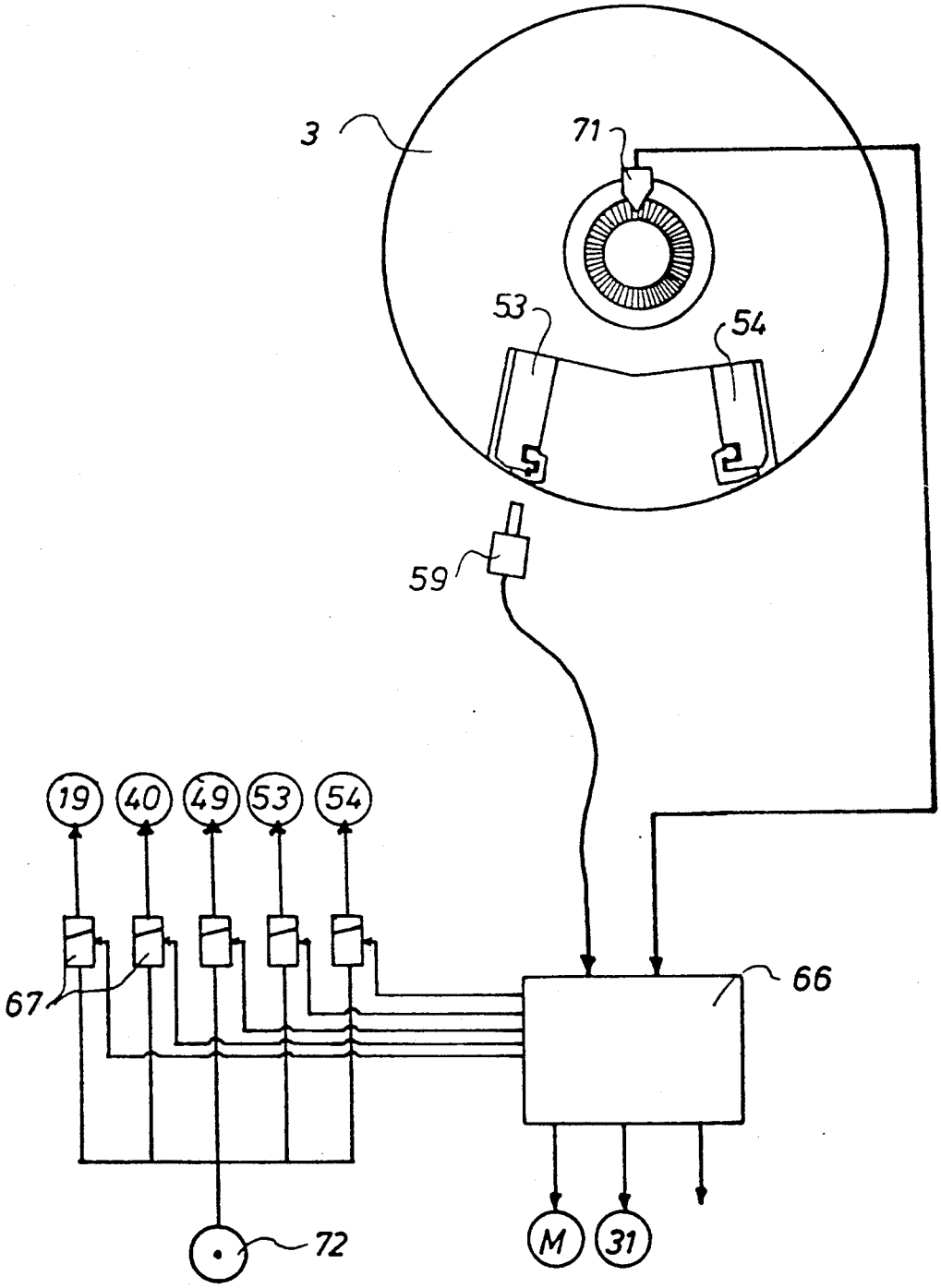
FIG. 5 is a schematic depiction of a control device and control computer for the present invention.

At the same time that the leading end 58 of the printing plate 27 being removed is passing between rollers 29 and 33, the driving rolls 28 and 29 start to transport the leading end 58 of a printing plate 60, previously placed in the first storage compartment 73, into the feeding area until the printing plate beginning or leading end 58 of the new printing plate 60 butts against a stop 51 of the plate clamping and tightening device 53. A position detector 59, as depicted in FIG. 5, for supervising the feeding of the printing plates 27 and 60 at the stop 51 sends a "Good" signal to a control computer 66 after which the clamping bar 56 is shut. The printing plate beginning 58 is now clamped. Now the plate cylinder 3 is turned counter-clockwise or forwards while the press-on roller 26 presses the printing plate 60 against the plate cylinder 3. If the position detector 59 were to signal that the printing plate 60 was not fed properly at the stop 51 of the plate clamping device 54, then a malfunction signal would be generated.

When reaching a printing plate clamping position C, as shown in FIG. 3 in which the printing plate trailing end 57 is pressed on the clamping surface 63, the clamping bar 55 closes and clamps the printing plate end 57. A subsequent activation of the tightening elements tightens the printing plate 60 on the plate cylinder 3. The position C lies, divided into angle degrees, only slightly, such as 5°–10°, behind the printing plate releasing position A so that the plate cylinder 3 has to be turned only slightly in a counter-clockwise direction from the printing plate releasing position until it reaches the position C shown in FIG. 3.

In position C, the press-on roller 26 will slightly bend the printing plate trailing end 57 around an edge 61 of the plate cylinder groove 52 so that the printing plate end 57 comes to lie on the clamping abutment surface 63 of the clamping device 54 within the periphery 62 of the plate cylinder 3 before it is held by the clamping bar 55. The press-on roller 26 is then swiveled back into the printing machine operating position. This is accomplished when the double-effective working cylinder 19 is admitted with pressure means and runs in the piston rod 21 which swivels the press-on roller 26 around the axis 30 of the drive roll 29 off the plate cylinder 3. The printing plate change is now finished.

Referring now primarily to FIG. 5, the control computer 66 is operatively connected with a number of electromagnet valves 67 which operate in the correct sequence at a command "printing plate change" depending on the positions of the plate cylinder 3 and as directed by a suitable software program. These various valves 67 supply their adjusting cylinders with a working medium from a pressure source 72. A suitable rotation angle generator 71 is associated with the plate cylinder 3 and provides data to the control computer 66 so that the positions A, B and C of the printing plate cylinder 3 can be arrived at. This is accomplished by also placing the electric or other drive means, such as the plate cylinder drive M, the drive for the sprocket wheel 31 and for the transport roll 33 and the like, under the control of the control computer 66, as is shown in FIG. 5.

Figure 6:
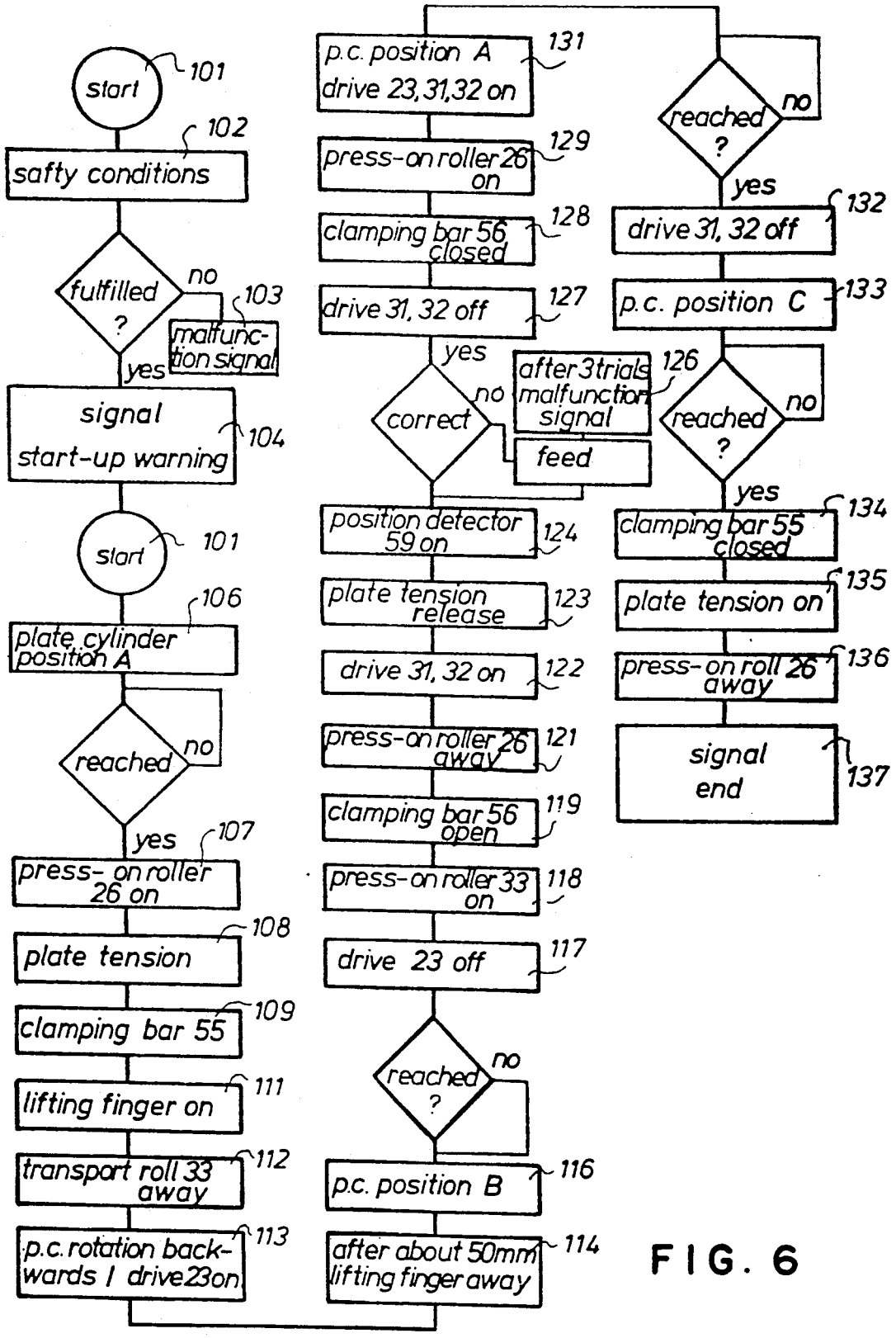
FIG. 6 is a logic diagram for the present invention.

This software program for the control computer 66 operates in accordance with the logic diagram shown in FIG. 6 and as discussed hereinafter. This logic diagram operates so that the various steps 101-137 are, as will now be discussed, carried out automatically one after the other. After initially operating a start release 101; in a first step 102, safety conditions of the rotary printing machine are asked such as "Is the cover plate 11 closed?" If all of the safety conditions are not fulfilled, a malfunction signal 103 is generated. When all of the security conditions are fulfilled, a signal "start-up-warning" is generated in a subsequent step 104.

After operating the start release 101, which may be activated manually or also by the control computer 66, the plate cylinder 3 is turned in step 106 into the plate cylinder position A. When the plate cylinder position A is reached, in a step 107, the press-on roller 26 is thrown onto the plate cylinder 3, then in step 108 the plate tension is switched off, in step 109 the clamping bar 55 is opened, in step 111 the lifting fingers 45 are swiveled into the periphery 62 of the plate cylinder 3 and the press-on roll 33 is swiveled off the driving roll 29 in step 112.

In a subsequent step 113, the drive 23 is activated and the plate cylinder 3 is driven backwards into the plate cylinder position B. After the plate cylinder 3 has covered a circumferential travel of about 50 mm the lifting fingers 45 are swiveled out of the periphery 62 in a step 114. The plate cylinder 3 goes on turning without interruption until it reaches the plate cylinder position B in step 116. When plate cylinder 3 has reached the plate cylinder position B, the drive 23 is switched off in a step 117. In step 118 the press-on roll 33 is thrown on the driving roll 29.

In step 119 the clamping bar 56 is opened. In the following step 121 the press-on roller 26 is slightly thrown off the plate cylinder 3 and only serves as a guide for the old and the new printing plates 27 and 60. Afterwards, the drives 31 and 32 are activated in step 122 and the plate tension is switched off in step 123. Now the old printing plate 27 is transported by means of the transport rolls 29 and 33 out of the clamping device 54: at the same time the new printing plate 60 is transported out of the storage compartment 73 to the clamping device 54.

In a step 124 a position detection of the new printing plate is enquired. When the position of the plate is not correct, a further feed of the printing plate 60 follows by means of the transport rolls 28 and 29. If the printing plate 60 still does not adjoin correctly after several enquiries by the position detector 59 then a malfunction signal is generated. However, when the feed of the printing plate 60 at the stop 51 is correct, the drive for 31 and 32 is switched off in step 127. The clamping bar 56 is closed in steps 128 and 129 and the press-on roller 26 is thrown onto the plate cylinder 3 under slight pressure. In the following step 131 the plate cylinder 3 is driven forwards into the plate cylinder position A; at the same time, the drives 23, 31 and 32 are activated. When reaching the plate cylinder position A the drives 31 and 32 are switched off in step 132. In step 133 the plate cylinder position C is attained by cylinder 3 and afterwards the clamping bar 55 is shut in step 134. The plate tension is switched on in step 135 and the press-on roller 26 is thrown off and switched off in step 136 The printing plate change is now finished and a signal end is generated.

It will thus be seen that the method and apparatus for automatically changing a printing plate in accordance with the present invention allows a first printing plate to be removed from the plate cylinder and placed in a first storage compartment. At the same time, a second plate cylinder is taken from a second storage compartment and is secured to the surface of the plate cylinder. This plate change is accomplished in a fully automatic manner and does not require any manual contact of the plate cylinder or of the printing plates being changed. It is therefore substantially quicker and more accurate than had been prior manual or semi-automatic procedures.

While a preferred embodiment of a method and apparatus for automatically changing a printing plate in accordance with the present invention has been set forth fully and completely hereinabove, it will be apparent to one of skill in the art that a number of changes in, for example, the sizes of the plate and associated cylinders, the type of printing plates used, the drive means for the plate cylinder and the like can be made without departing from the true spirit and scope of the present invention, which is accordingly to be limited only by the following claims.

What is claimed is:

1. A method for automatically changing a printing plate on a plate cylinder of a rotating printing machine including the steps of:

providing a plate cylinder having a discontinuous peripheral surface including recessed area;

positioning a first printing plate having leading and trailing ends on said peripheral surface;

providing means for releasably clamping said leading and trailing ends of said printing plate on said plate cylinder;

providing a printing plate storage chamber having first and second upper, generally vertical printing plate storage compartments and first and second front curved walls having first and second lower ends;

locating said printing plate storage chamber adjacent said plate cylinder with said first and second lower ends of said first and second curved front walls being adjacent and generally tangential to said peripheral surface of said plate cylinder;

locating at least one movable lifting finger between said peripheral surface of said plate cylinder and said second lower end of said second curved wall;

placing a second printing plate to be secured to said plate cylinder in said first storage compartment of said storage chamber located adjacent said plate cylinder;

rotating said plate cylinder in a first direction to a printing plate trailing end releasing position;

opening said trailing end clamping means on said plate cylinder and releasing said trailing end of said first printing plate to be removed from said plate cylinder;

moving said lifting finger into a selected one of said recessed areas and beneath said peripheral surface of said plate cylinder and into engagement with an inner surface of said released trailing end of said first printing plate;

rotating said plate cylinder in a second direction opposite to said first direction;

positioning said lifting finger between said released trailing end of said first printing plate and said peripheral surface of said plate cylinder and separating said first printing plate from said plate cylinder;

directing said trailing end of said first printing plate into engagement with said second curved wall;

continuing rotation of said plate cylinder in said second direction and guiding said separated first printing plate into said second storage compartment;

opening said leading end clamping means on said plate cylinder and releasing said leading end of said first printing plate;

feeding a leading end of said second printing plate from said first storage compartment to said leading end clamping means;

closing said leading end clamping means and securing said leading end of said second printing plate on said plate cylinder;

rotating said plate cylinder in said first direction and withdrawing said second printing plate from said first storage compartment and placing said second printing plate on said plate cylinder; and closing said trailing end clamping means to secure a trailing end of said second printing plate to said plate cylinder.

2. The method of claim 1 further including the steps of providing a printing plate leading end stop at said leading end clamping means, generating a signal when said second printing plate leading end contacts said stop, and closing said leading end clamping means after said signal is generated.

3. An apparatus for automatically changing a printing plate on a plate cylinder of a rotary printing machine, said apparatus comprising:

a rotatable plate cylinder having a discontinuous peripheral surface including recessed areas;

a first printing plate;

means for releasably carrying said first printing plate on said peripheral surface of said plate cylinder;

a printing plate storage chamber positioned adjacent said plate cylinder and having first and second upper, generally vertical printing plate storage compartments and first and second front curved walls having first and second lower ends positioned adjacent and generally tangential to said peripheral surface of said plate cylinder;

at least one movable lifting finger positioned between said peripheral surface of said plate cylinder and said second lower end of said second curved wall;

means for moving said lifting finger into a selected one of said recessed areas and beneath said peripheral surface of said plate cylinder into engagement with an inner surface of a released end portion of said first printing plate to elevate and separate said released end of said first printing plate from said peripheral surface of said plate cylinder;

means to transport said separated first printing plate from said peripheral surface of said plate cylinder to said second plate storage compartment;

a second printing plate positioned in said first plate storage compartment of said printing plate storage chamber; and means to transport said second printing plate to said plate cylinder to be releasably carried on said peripheral surface of said plate cylinder.

4. The apparatus of claim 3 wherein said transport means is a plurality of transport rolls positioned intermediate said storage chamber and said plate cylinder and further including drive means for at least one of said transport rolls.

5. The apparatus of claim 4 further including a first press-on roll which is supported for selective engagement with said one of said transport rolls.

6. The apparatus of claim 5 further including means for moving said first press-on roller into engagement with said one of said transport rolls.

7. The apparatus of claim 5 further including a second press-on roller having a drive means.

8. The apparatus of claim 7 further including means for moving said second press-on roller into contact with said plate cylinder.

9. The apparatus of claim 4 further including a plurality of said lifting fingers located adjacent said transport rolls.

10. The apparatus of claim 9 wherein said lifting fingers are supported on a rotatable lifting finger shaft.

11. The apparatus of claim 10 wherein each of said lifting fingers has a peak and further wherein said peaks are positioned to be pivotable beneath said periphery of said plate cylinder.

12. The apparatus of claim 11 wherein said means on said plate cylinder for carrying a printing plate includes at least one clamping bar having spaced lifting finger peak receiving openings.

13. The apparatus of claim 10 further including means for rotating said lifting finger shaft.

14. The apparatus of claim 3 wherein said printing plate storage chamber is made of first and second members which are connected together by a hinge joint.

* * * * *